United States Patent [19]

Minami et al.

[11] 4,086,890

[45] May 2, 1978

[54] CARBURETOR WITH ALTITUDE COMPENSATION ASSEMBLY

[75] Inventors: Hidehiro Minami, Yokohama; Kazuo Abe, Tokyo, both of Japan

[73] Assignee: Nissan Motor Company, Limited, Japan

[21] Appl. No.: 675,625

[22] Filed: Apr. 9, 1976

[30] Foreign Application Priority Data

Apr. 10, 1975 Japan ..... 50/48814[U]

[51] Int. Cl.[2] ..... F02B 33/00

[52] U.S. Cl. ..... 123/119 EC; 123/124 B

[58] Field of Search ..... 123/119 EC, 32 EE, 119 E, 123/32 EA, 32 AE, 119 D, 124 R, 124 B

[56] References Cited

U.S. PATENT DOCUMENTS

| | | | |
|---|---|---|---|
| 3,745,768 | 7/1973 | Zechnall | 123/32 EE |
| 3,759,232 | 9/1973 | Wahl | 12 3/32 EE |
| 3,906,910 | 9/1975 | Szlaga | 123/119 EC |
| 3,921,612 | 11/1975 | Aono | 123/119 E |
| 3,963,009 | 6/1976 | Mennesson | 123/119 EC |

*Primary Examiner*—Ronald H. Lazarus

[57] ABSTRACT

An altitude compensation assembly is incorporated into a conventional carburetor for use with an electronic closed loop air-fuel ratio control system in order to obviate an undesirable enrichment of an air-fuel mixture due to a reduction of air density while a vehicle is operated at higher altitudes.

5 Claims, 3 Drawing Figures

CARBURETOR WITH ALTITUDE COMPENSATION ASSEMBLY

Figure 1:
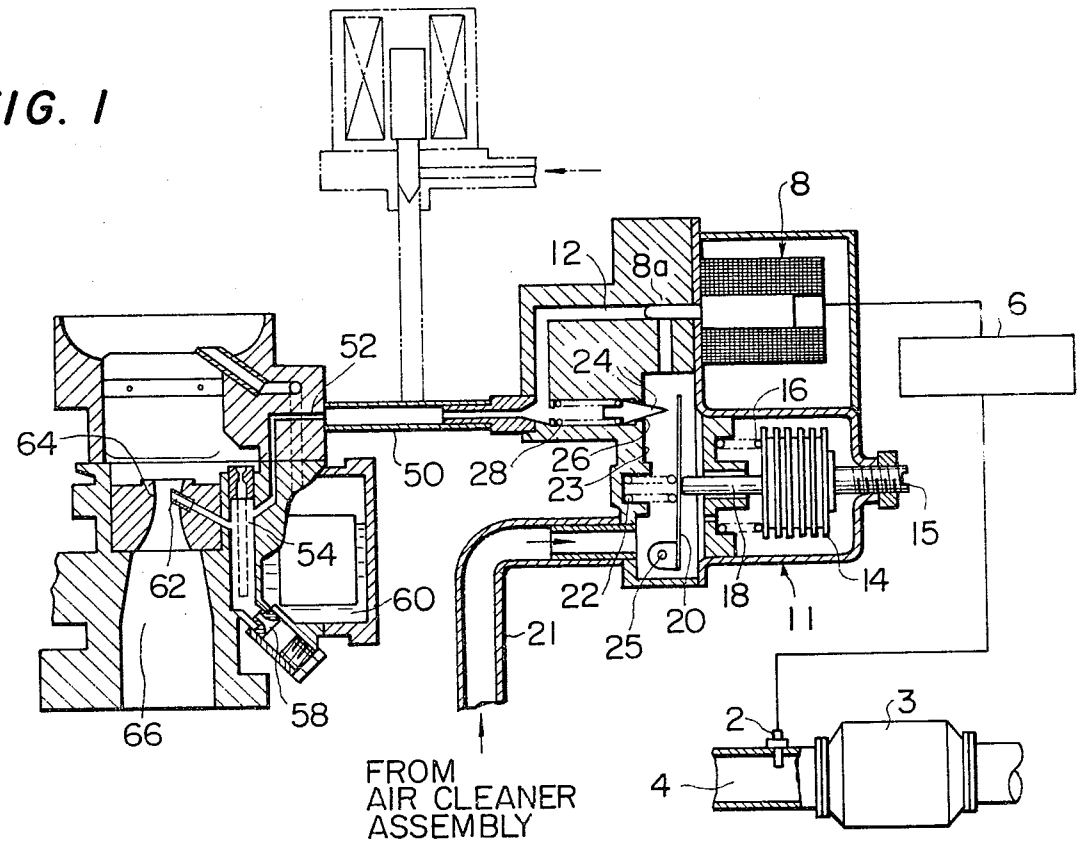

This invention relates generally to an automotive engine carburetor, and particularly to a carburetor for use with an electronic closed loop control system, and more particularly to such a carburetor which has an altitude compensation assembly for optimally controlling an air-fuel ratio while a vehicle is operated at higher altitudes.

Various systems have been proposed to optimally control the air-fuel ratio of an air-fuel mixture to an internal combustion engine with regard to various modes of engine operation in order to effectively reduce noxious components (such as nitrogen oxides ($NO_x$), carbon monoxide (CO), and hydrocarbons (HC)) contained in exhaust gases. Such a system utilizes the concept of electronic closed loop control system based on a sensed concentration of a component in the exhaust gases from the engine.

A conventional electronic closed loop air-fuel ratio control system generally comprises, an exhaust gas sensor for sensing a concentration of a component in exhaust gases and generating a signal representative thereof, a first control unit connected to the exhaust gas sensor for deriving the signal therefrom and generating a signal indicative of an optimum air-fuel ratio based on the signal from the exhaust gas sensor, a second control unit connected to the first control unit for deriving the signal therefrom and generating a control signal based on the signal from the first control unit, and an actuator connected to the second control unit to optimally control an air-fuel mixture fed to the engine in dependence of the control signal derived therefrom, which actuator is usually an electromagnetic valve provided in an air passage connected at one end thereof to an air bleed chamber or to another air passage by-passing an intake pipe wherein a throttle valve is deposited.

Such an electronic closed loop control system, especially when a so-called three-way catalytic converter is employed for reducing the noxious components, is required to finely control the air-fuel mixture ratio. This is because the effect of the three-way catalytic converter is maximized when the air-fuel ratio is maintained in the vicinity the stoichiometric air-fuel ratio. A three-way catalytic converter, as is well known, has a characteristic of deoxidizing $NO_x$ and oxidizing both CO and HC at the same time. Therefore, a carburetor for use with the electronic closed loop control system is usually equipped with an electrical unit for the purpose of fine control of the air-fuel ratio of the air-fuel mixture.

In the above-described control system, however, there is encountered a problem that, while the vehicle is operated at higher altitudes, the air-fuel mixture becomes undesirably richer due to a reduction in air density. This is because the electromagnetic valve, which is provided, for example, in the air passage connected to the air bleed chamber, cannot supply a sufficient amount of air by its "on" and "off" operation. In this connection, provided that the electromagnetic valve is designed so as to have a large duration of "on" and "off" operation in order to supply a sufficient amount of air while the vehicle is operated at higher altitudes, it becomes, in turn, very difficult to precisely regulate the air-fuel ratio, resulting in causing undesired phenomena, such as insufficient reduction of the noxious components, unstable engine operation, and a hunting, etc.

It is therefore an object of the present invention to incorporate an altitude compensation assembly into a conventional carburetor for use with an electronic closed loop air-fuel ratio control system, the altitude compensation assembly being responsive to changes in atmospheric pressure due to changes in altitude for obviating undesirable enrichment of the air-fuel mixture while a vehicle is operated at higher altitudes.

Figure 2:
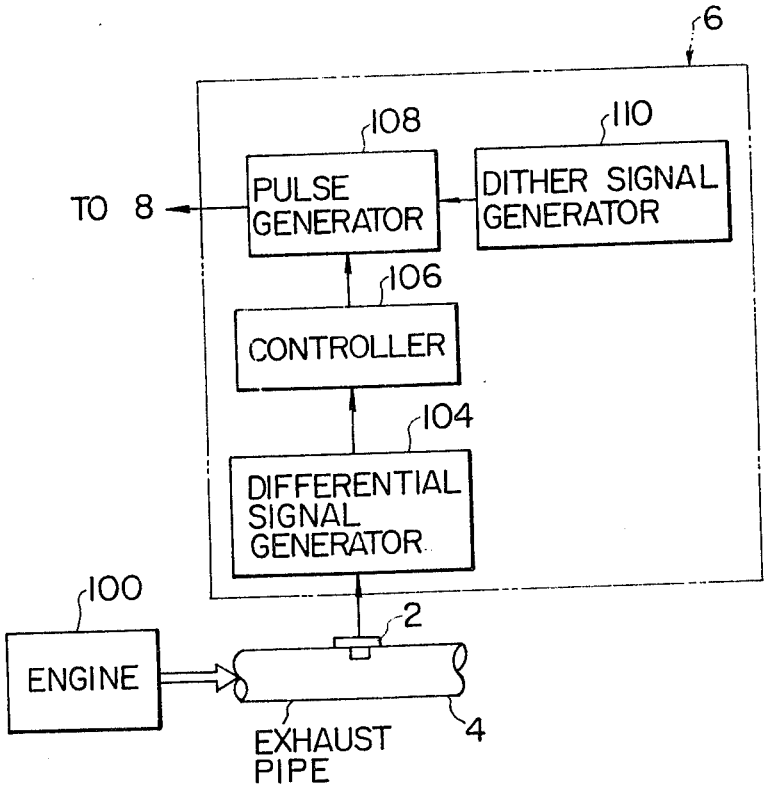
Figure 3:
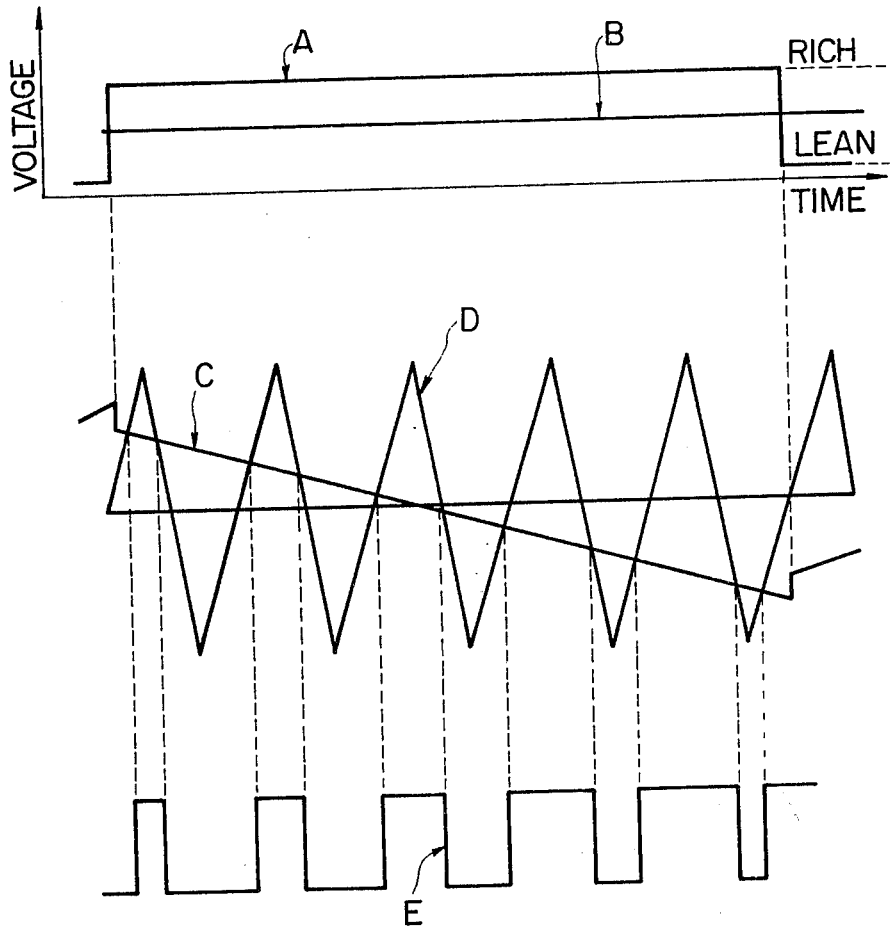

This and other objects, features and many of the attendant advantages of this invention will be appreciated more readily as the invention becomes better understood by the following detailed description, wherein:

FIG. 1 shematically illustrates a preferred embodiment of the present invention;

FIG. 2 schematically illustrates an example of a conventional electronic closed loop control system for use with the FIG. 1 embodiment; and FIG. 3 shows various waveforms which demonstrate the basic control concept of the FIG. 2 example.

Reference is now made to FIG. 1, which schematically illustrates a preferred embodiment of the present invention. An exhaust gas sensor 2, such as an oxygen analyzer, is provided in an exhaust gas pipe 4 to sense a concentration of a component of exhaust gases, generating an electrical signal representing the sensed concentration of a component. The signal from the exhaust gas sensor 2 is fed to a conventional unit 6 which generates a train of pulses based on the signal applied. The function of the conventional control unit 6 will be described in detail in connection with FIGS. 2 and 3. The train of pulses from the control unit 6 is then fed to an electromagnetic valve 8 which is provided with a plunger **8*a* reciprocally movable in an air passage 12 in response to the pulses applied thereto. The valve 8 thus controls the amount of air flowing from an air cleaner assembly (not shown) to an air bleed chamber 54 through an air passage 21, an air chamber 23, air passages 12, 50, and 52, thereby to maximize the efficiency of a catalytic converter 3 provided downstream of the exhaust gas sensor 2**.

As the catalytic converter 3, usually employed is a so-called three-way catalytic converter so as to reduce $NO_x$ (nitrogen oxides), CO (carbon monoxide), and HC (hydrocarbons) at the same time.

The air from the air passage 52 is mixed, within the air bleed chamber 54, with fuel being supplied through a main jet 58 from a fuel bowl 60. The air-fuel mixture is then sucked into an intake pipe 66 via a discharging nozzle 62 which protrudes into a venturi 64.

The system so far described in connection with FIG. 1 has been known to those skilled in the art in question. The present invention consists in providing an altitude compensation assembly 11 in the aforementioned conventional air-fuel ratio control system. The altitude compensation assembly 11 comprises a bellows 14, a lever 20, and a needle valve 24, etc. The purpose of the provision of the altitude compensation assembly 11 is, as is already referred to at the outset of the specification, to optimally control the air-fuel ratio while the vehicle is operated at higher altitudes.

The bellows 14 confines a suitable inactive gas therein and inflatable with an increase in altitude against a compression spring 16. As shown, a pushing rod 18 is fixedly attached to the bellows 14 and pushes the lever 20 against a compression spring 22 while the vehicle is operated at higher altitudes. The lever 20 is so arranged as to be pivotally movable around a suitable pin 25 within the air chamber 23. At lower atitudes, the needle valve 24 is so positioned as shown in FIG. 1 by means of a compression spring 28 to allow only through the air passage 12. On the other hand, as the vehicle is operated at higher altitudes where the air density is reduced, the lever 20 pushes the needle valve 24 leftward to allow air to flow through a metering orifice 26. It goes without saying that the amount of air flowing through the metering oridice 26 is determined by the opening degree of the needle valve 24, which depends upon the altitude of the vehicle, and the diameter of the metering orifice 26. In practice, the opening degree of the needle valve 24 is indirectly controlled by an adjusting screw 15.

Thus, in accordance with the present invention, the undesirable enrichment of the air-fuel mixture is avoided which happens due to a reduction of the air density while the vehicle is operated at higher altitudes.

In the above, the electromagnetic valve 8 can be isolately arranged with regard to the altitude compensation assembly 11 as shown in FIG. 1 by chained lines, and the valve 8 can be replaced by other suitable means such as a control valve assembly provided with a diaphragm actuator or a servo-motor. Furthermore, the air passage 52 can be connected not to the air bleed chamber 54 but to an air passage (not shown) bypassing the intake pipe 66 wherein a throttle (not shown) is deposited.

Reference is now made to FIGS. 2 and 3, in which schematically illustrated are an example of a conventional electrical closed loop air-fuel control system for use with an internal combustion engine 100 having the carburetor shown in FIG. 1 (FIG. 2), and several waveforms developed or derived from different elements of the FIG. 2 system (FIG. 3). The purpose of the system of FIG. 2 is to electrically control the air-fuel ratio of an air-fuel mixture being supplied to the engine 100. The sensor 2, such as an oxygen analyzer, for sensing the concentration of oxygen in the exhaust gases, is disposed in the exhaust pipe 4 in such a manner as to be exposed to the exhaust gases. An electrical signal derived from the sensor 2 is fed to a differential signal generator 104 which generates an electrical signal representative of a difference value between the magnitudes of the signal from the sensor 2 and a reference signal. A portion of the waveform of the signal from the sensor 2 is depicted by reference character A in FIG. 3. The reference signal magnitude, which is illustrated by reference character B in FIG. 3, is previously determined in due consideration of optimum air-fuel ratio of the air-fuel mixture supplied to the engine 100 for maximizing the efficiency of the three-way catalytic converter 3 (FIG. 1) provided in the exhaust pipe 4 downstream of the sensor 2, etc. The signal representative of the difference value from the differential signal generator 104 is then fed to control means 106 which usually includes a conventional p-i (proportional-integral) controller. The provision of the p-i controller, as is well known in the art, is to improve the efficiency of the electronic closed loop control system, or in other words, to facilitate a rapid transient response of the system. The output signal from the control means 106, which is depicted by reference character C in FIG. 3, is fed to the next stage, viz., a pulse generator 108 which also receives a dither signal (D in FIG. 3) from a dither signal generator 110 to generate a signal E consisting of a train of pulses as shown in FIG. 3. Each pulse of the signal E has width which corresponds to the duration when the signal D is larger than the signal C as schematically shown in FIG. 3. The train of pulses of the signal E is then fed to the electromagnetic valve 8 in FIG. 1 in order to regulate the air-fuel mixture ratio as described in connection with FIG. 1.

In the above, the altitude compensation assembly 11 can be modified in a manner that the bellows 14 is omitted and the valve 24 is manually opened or closed by a vehicle driver.

From the foregoing, in accordance with the present invention, by providing the altitude compensation assembly, the undesirable enrichment of the air-fuel mixture can be removed which results from a reduction of the air density while the vehicle is operated at higher altitudes.

What is claimed is:

1. In a carburetor for use with an electronic closed loop control system for optimally controlling an air-fuel ratio of the air-fuel mixture to an internal combustion engine, which system comprises in combination: an air cleaner assembly; a fuel supply tank; an air intake pipe connected to the engine; an exhaust pipe; an exhaust gas sensor provided in said exhaust pipe and generating an electrical signal representing a concentration of a component in exhaust gases; a control unit receiving the signal from said exhaust gas sensor and generating a command signal based on the signal from said exhaust gas sensor; a fuel passage extending between said fuel supply tank and said air intake pipe connected to the engine; an air passage extending between a portion of said fuel passage and said air cleaner assembly; and an actuator provided in said air passage to control the amount of air flowing therethrough into said fuel passage for regulating said air-fuel ratio in response to said command signal, wherein the improvement comprises, altitude compensating means provided in said air passage for controlling the amount of air flowing into said fuel passage while a vehicle is operated at higher altitude, which altitude compensating means includes, a bellows inflatable with increase in altitude, first means operatively connected to said bellows responsive to the volume change thereof, an auxiliary air passage bypassing said air passage in such a manner as to terminate at portions of said air passage upstream and downstream of said actuator, and second means provided in said auxiliary air passage and responsive to the volume change of said bellows through said first means to control the amount of air flowing into said fuel passage.

2. A carburetor claimed in claim 1, wherein said altitude compensation means includes means responsive to changes in atmospheric pressure due to changes in altitude for automatically increasing said air-fuel ratio by increasing the amount of air flowing into said fuel passage.

3. A carburetor claimed in claim 1, wherein said first means includes, first push means attached to said bellows, second push means being forcibly pushed by said bellows through said first push means with increases in altitude and operatively connected to said second means, and wherein said second means is a valve.

4. A carburetor claimed in claim 1, further comprising an adjusting means for adjusting the degree of the volume change of said bellows.

5. A carburetor claimed in claim 4, wherein said adjusting means is a screw.

* * * * *